United States Patent [19]

Boehler

[11] 4,114,829

[45] Sep. 19, 1978

[54] GUIDE FOR FILAMENTARY MATERIAL

[75] Inventor: William L. Boehler, Summerville, S.C.

[73] Assignee: The Partnership of W. L. Boehler and A. G. Whaley Co., Inc., Andrews, S.C.

[21] Appl. No.: 808,528

[22] Filed: Jun. 21, 1977

[51] Int. Cl.[2] ..... B65H 57/08; B65H 57/26

[52] U.S. Cl. ..... 242/157 R; 24/131 C; 242/157 C; 248/230

[58] Field of Search ..... 242/157 R, 157 C, 157.1; 43/24; 248/74 A, 74 R, 230; 24/131 C, 257 R

[56] References Cited

U.S. PATENT DOCUMENTS

| | | | |
|---|---|---|---|
| 241,787 | 5/1881 | Clark | 242/157 R |
| 1,150,336 | 8/1915 | Brooks | 24/131 C |
| 2,319,462 | 5/1943 | Kruse | 43/24 |
| 2,561,675 | 7/1951 | Ross | 242/157 R |
| 2,596,835 | 5/1952 | Benge | 242/157 R |
| 2,721,412 | 10/1955 | Smiley | 242/157 R |
| 3,099,889 | 8/1963 | Verneuil | 43/24 |

FOREIGN PATENT DOCUMENTS

| | | | |
|---|---|---|---|
| 1,100,127 | 3/1955 | France | 43/24 |
| 12,828 of | 1902 | United Kingdom | 43/24 |

*Primary Examiner*—Stanley N. Gilreath

*Attorney, Agent, or Firm*—Kenyon & Kenyon, Reilly, Carr & Chapin

[57] ABSTRACT

A guide for a filamentary material, such as yarn, thread, rope or the like which comprises a coiled spring of spring steel having two extending ends on one of which is formed a pigtail to act as a guide and on the other of which is formed a hook for engaging the side containing the pigtail, thereby permitting the spring portion to be slid over a rod and the hook on the other side pressed to engage the first side thereby allowing the guide to be clamped onto the rod at any desired location and permitting ease of adjustment.

9 Claims, 3 Drawing Figures

GUIDE FOR FILAMENTARY MATERIAL

BACKGROUND OF THE INVENTION

This invention relates to textile related processes in general, and more particularly to an improved guide for textile yarns, threads and other types of filamentary material.

In various textile processes such as weaving, knitting, dying, etc., there is often a need to guide a yarn or thread from one place to another. For example, guides are used extensively in guiding yarn or thread from spools to the machine that does the weaving or knitting. Typically, such guides constitute a shaft having on the end thereof what is known as a pigtail. The pigtail is often circular, but in some cases it takes another shape such as an oval shape. Typically, such guides have constituted a structure in the nature of an eye bolt. For mounting purposes the bolt sometimes was mounted to an angle bracket with appropriate holes drilled therethrough and nuts placed on the shaft of the guide on both sides of the bracket to hold it in place. Another type of mounting comprised screwing the threaded end of the bolt into a metal block which contained a bore the size of a shaft on which mounting was to take place with a set screw hole provided in the block and a screw placed therein whereby the block could be slid onto a rod, put in place and the set screw then tightened down. Adjustment, requires loosening the set screw and then moving the metal block with the guide thereon. In the previously mentioned type of installation where the guides are inserted through holes drilled in an angle bracket, adjustment can only be made by drilling new holes and physically moving the guide.

Thus, the guides presently in use are relatively expensive, requiring a threaded shaft at the very least, along with means for mounting the threaded portion and such devices are not easy to adjust. The type of device presently in use, which is adaptable for placement on the rod, is even more costly since a metal block must be formed containing a bore and containing two tapped holes, one for a set screw and one into which the threaded shaft of the guide must be screwed.

Thus, the need for a simpler guide for use with yarn, thread and other filamentary material which is less expensive to manufacture and easier to adjust, becomes evident.

SUMMARY OF THE INVENTION

The present invention provides such a guide. The guide is formed by coiling a length of spring steel wire such as to form a coil from which the wire projects on both sides, the two projecting sides of wire being essentially parallel to each other, and the first of the sides being longer than the second. The first longer side has the pigtail guide formed on its end by an appropriate bend. The other side has formed on its end a hook capable of engaging the first side when it is bent toward the first side. The diameter of the coil is made just slightly larger than a rod onto which the guide is to be placed. In use, as many of the pigtail guides of the present invention as are required are slid over the rod to the desired position. Thereupon, the second extending side is bent toward the first side and the hook on the end thereof brought into engagement with the first side. As the two sides are brought together in this manner, the spring is compressed and, in effect, clamps onto the rod to hold the guide fixed in place. Adjustment simply requires disengaging the two sides and adjusting the position. Thus, an extremely simple, low cost, easy to manufacture and infinitely adjustable guide for use in guiding yarns, threads and the like, is achieved.

DETAILED DESCRIPTION OF THE INVENTION

Figure 2:
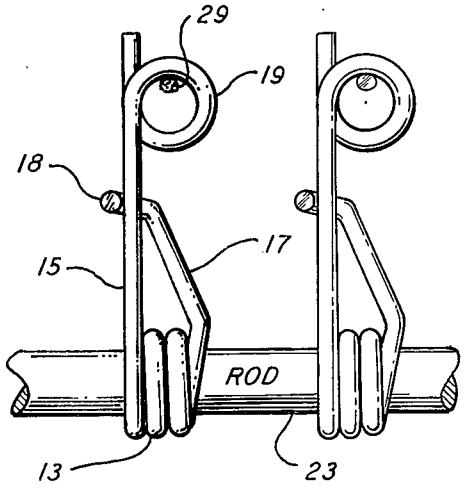
FIG. 2 is a front view of the guide of the present invention clamped onto a rod.
Figure 3:
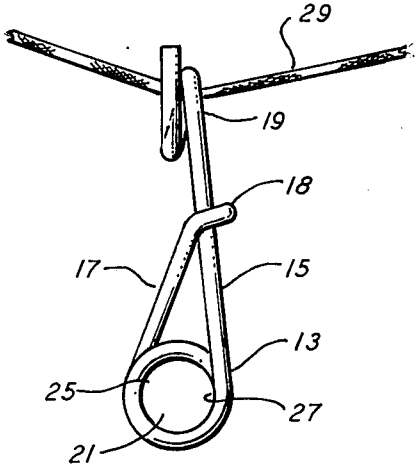
FIG. 3 is an end view of the device of FIG. 2.
Figure 1:
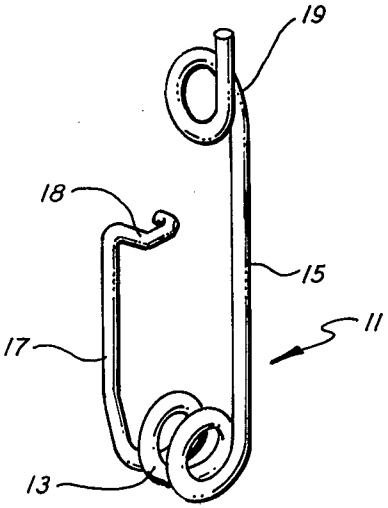
FIG. 1 is a perspective view of the device of the present invention in the unclamped position.

As illustrated by FIGS. 1–3, the guide of the present invention indicated generally as 11, is formed from a piece of spring steel wire. The exact size of the wire will of course depend on the application. In particular, heavier sizes of wire will be used where the material to be guided is heavier and thinner gauges of spring steel wire for thinner material such as threads. Typically, somewhere between five and twelve gauge spring steel wire will be used, although it is envisioned that an application may arise where a larger gauge wire will be necessary, e.g., when guiding heavy rope.

The wire is bent to form a plurality of loops, typically 2½, to thus form a spring portion 13. Extending essentially parallel from the two ends of the spring portion 13 are lengths of wire 15 and 17. Length 15 is longer than length 17 and contains on its end a pigtail 19 obtained by bending the end of the wire. Although shown as a circular pigtail, the shape of pigtail 19 may be made as desired, for example, oval. Again, the size of the pigtail opening 19 will be dictated by the particular application. Typically, it will range between one-fourth and one-half inch. The same is true of the opening 21 within the coil spring 13. Along with the size of the pigtail and the gauge of the wire, it will be sized for the particular application. Typically, for most textile operations, a size opening 21 between three-eighths and five-eighths inches will normally be used. For heavier material such as ropes and the like, sizes of the opening 21 up to 1½ inches are envisioned. This size, will of course, be approximately the same as a rod 23 onto which the guide 11 is clamped. The opening 21 will be just slightly larger than the rod 23 with which it is to be used so as to permit it to be slid thereon.

When put into use, the guide, in the unstressed condition shown on FIG. 1, will be slid onto the rod 23. As many guides as are required will be placed on the rod and moved to the desired locations. In the embodiment of FIG. 3 two such guides are shown. Thereupon, the length 17 will be bent toward the length 15 with the hook 18 brought around to engage the length 15. As the hook 18 is brought to this position and engages the length 15, the portions of the spring at 25 and 27 will be brought inward and will act to clamp the guide onto the rod 23. The guide is now ready to use. If adjustment becomes necessary, all one need do is disengage the hook 18 from the length 15, slide or rotate the guide to a new position, and again engage the hook 18 with the length 15.

Rod 23 will be supported on the textile machine or other apparatus with which the guides are to be used, and will extend generally perpendicular to the direction of guiding. The thread 29 or the like to be guided, as illustrated, at least at the point where it passes through the pigtail, extends generally perpendicular to the rod 23.

It should be noted that in instances where angle brackets are used in the prior art as a base for attachment of threaded guides, the purpose of the angle brackets is primarily that of supporting the guides. Thus, when employing the present invention, these angle brackets can be placed by rods 23 without difficulty. The rods are of essentially the same weight and cost, and thus, do not add to the expense of the overall installation. This is true particularly when using a hollow rod or tube as the support. As used herein, the word rod is meant to include such.

Although it is now envisioned that the present invention will be most applicable to textile processes, it is generally applicable anywhere where filamentary materials are guided and may be used with a rope, tubing, wire and so forth. Furthermore, it can be adapted to be a separator by modifying the pigtail end 19. For example, an end without a pigtail could be used to separate two strands of yarn, one on each side. Furthermore, additional means can be placed on the end of the pigtail for separating or other type of guiding. In general, pigtails and any other such means can be considered guiding means in the terms of this specification. These and other modifications may be made without departing from the spirit of the invention which is intended to be limited solely by the appended claims.

I claim:

1. A guide for guiding a filamentary material comprising (a) a piece of spring steel wire having a coiled portion forming a spring of essentially circular cross-section with first and second lengths of wire extending therefrom, generally parallel to each other, said first length being longer than said second length;

(b) means for holding said two lengths together; and (c) means on the end of said first length for guiding filamentary material, whereby said coiled portion may be slid over a rod of diameter slightly smaller than the diameter of said coiled portion and said two lengths brought and held together thereby clamping said guide onto said rod.

2. A guide according to claim 1 wherein said means for holding comprise a hook formed on the end of said second length for engaging said first length when said two lengths are brought together.

3. A guide according to claim 1 wherein said means for guiding comprise a pigtail.

4. A guide according to claim 3 wherein said pigtail comprises a bent portion of said first length.

5. A guide according to claim 4 wherein said bent portion is bent into a generally circular shape.

6. A guide according to claim 3 wherein said spring steel wire has a gauge in the range between five and twelve and said coiled portion has an inside diameter between three-eighths inch and one-half inch.

7. A guide according to claim 6 wherein said coiled portion has an inside diameter between three-eighths and five-eighths inches and said pigtail has a diameter approximately between one-fourth inch and one-half inch.

8. A system for guiding a plurality of strands of filamentary material comprising:

(a) a rod;

(b) a plurality of guides, each guide comprising (1) a piece of spring steel wire having a coiled portion forming a spring of essentially circular cross-section with first and second lengths of wire extending therefrom, generally parallel to each other, said first length being longer than said second length;

(2) a hook formed on the end of said second length for engaging said first length when said two lengths are brought together; and (3) means on the end of said first length for guiding filamentary material, whereby said coiled portion may be slid over said rod of a diameter slightly smaller than the diameter of said coiled portion and said two lengths brought and hooked together thereby clamping said guide onto said rod.

9. A guide according to claim 8 wherein said means for guiding comprises a pigtail.

* * * * *